US007299672B2

(12) United States Patent
Schwarz et al.

(10) Patent No.: US 7,299,672 B2
(45) Date of Patent: Nov. 27, 2007

(54) BRIDLE UNIT

(75) Inventors: Christoph Schwarz, Neunkirchen-Struthütten (DE); Hans-Joachim Pölking, Kreuztal (DE); Susanne Hein, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 110 days.

(21) Appl. No.: 10/480,872

(22) PCT Filed: Jun. 11, 2002

(86) PCT No.: PCT/EP02/06354

§ 371 (c)(1),
(2), (4) Date: Dec. 11, 2003

(87) PCT Pub. No.: WO03/002278

PCT Pub. Date: Jan. 9, 2003

(65) Prior Publication Data

US 2004/0148994 A1 Aug. 5, 2004

(30) Foreign Application Priority Data

Jun. 27, 2001 (DE) ..... 101 30 969

(51) Int. Cl.
*B21B 39/16* (2006.01)

(52) U.S. Cl. ..... 72/205; 72/164; 72/10.7

(58) Field of Classification Search ..... 72/205, 72/164, 165, 160, 161, 13.4, 46, 43, 44
See application file for complete search history.

(56) References Cited

U.S. PATENT DOCUMENTS 2,768,542 A * 10/1956 Rowe et al. ..... 72/205
3,401,546 A * 9/1968 Greenberger ..... 72/12.6
3,733,869 A * 5/1973 Elgert et al. ..... 72/205
6,173,596 B1 * 1/2001 Lazzaro et al. ..... 72/13.4

FOREIGN PATENT DOCUMENTS

JP 51 109264 A 9/1976
JP 52 052852 A 4/1977

OTHER PUBLICATIONS

Database WPI, Section Ch, Week 197414, Derwent Publications Ltd., London, GB; Class M21 & JP 49 010426 B (Hitachi Ltd), Mar. 11, 1974.

* cited by examiner

*Primary Examiner*—Derris H. Banks
*Assistant Examiner*—Debra M Wolfe
(74) *Attorney, Agent, or Firm*—Friedrich Kueffner

(57) ABSTRACT

A bridle unit assigned to a rolling stand with several rolls arranged in adjustable positions below and above the strip flow, which can be moved by means of a drive from an initial position to the strip and from the strip back into the initial position, wherein the roll situated closest to the roll gap of the rolling stand can be moved by means of an additional drive from an initial position below the strip flow or from an initial position above the strip flow to the strip, such that, when the bridle unit is used for coloring the strip, the circumference of the roll deflects the strip upward or downward from the horizontal pass line and forms a bite angle above or below the pass line.

5 Claims, 3 Drawing Sheets

BRIDLE UNIT

Figure 1:
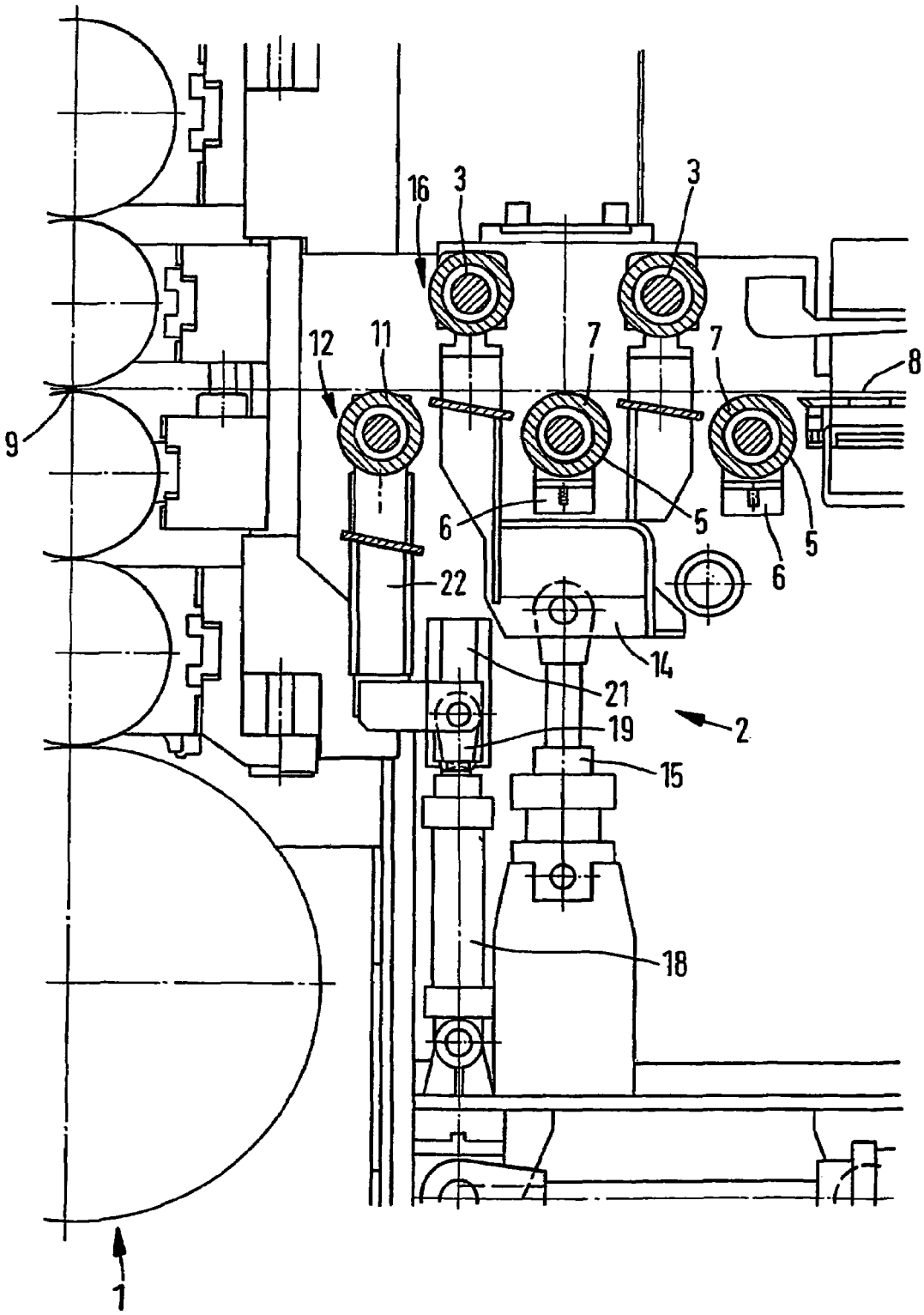

The invention concerns a bridle unit, which is assigned to a rolling stand and has several rolls arranged in adjustable positions below and above the strip flow, which can be moved by means of a drive from an initial position to the strip and from the strip back into the initial position.

Bridle units guide and level the strip and maintain its tension by causing the adjustable rolls arranged above the strip flow to be lowered from the initial position and into the working position on the surface of the strip by means of a drive. The strip, which is subjected to repeated reverse bending in the working position, leaves the bridle unit at the roll closest to the roll gap of the assigned rolling stand at the height of the pass line of the rolling stand.

Bridle units of this type are known, for example, from JP 52[1977]-052,852 A, JP 51[1976]-109,264 A, and U.S. Pat. No. 2,768,542 A. It is also known from the US document that a roll situated closest to the roll gap of the rolling stand can be set onto the strip both from above and from below.

If coloring of the strip is required, i.e. imparting color to the strip, an additional coloring roll must be placed between the bridle unit and the assigned rolling stand. The additional coloring roll and the mechanical devices necessary for its operation lengthen the distance between the roll gap of the rolling stand and the payoff of the strip. However, process disadvantages, especially greater tolerance lengths, are associated with the greater distance between roll gap and payoff.

Therefore, the objective of the invention is to create a bridle unit that makes it possible to color the strip without lengthening the distance between the roll gap and payoff.

The solution of this problem is based on the idea of decoupling the roll situated closest to the roll gap of the rolling stand, so that the roll can be used as a bridle roll or coloring roll.

In particular, the objective of the invention is achieved with a bridle unit of the type specified at the beginning in such a way that the roll situated closest to the roll gap of the rolling stand can be moved by an additional drive from an initial position below the strip flow or from an initial position above the strip flow to the strip, such that, when the bridle unit is used for coloring the strip, the circumference of the roll deflects the strip upward or downward from the horizontal pass line and forms a bite angle above or below the pass line.

If the roll near the roll gap remains in its initial position below the strip flow at the height of the bridle rolls arranged in a fixed position there, it operates in the conventional way as a bridle roll. The strip leaves the bridle unit at the height of the pass line of the rolling stand.

If the roll near the roll gap is to operate as a coloring roll, it is moved from the initial position above or below the strip flow far enough towards the strip that the strip enters the roll gap from the bridle unit at an acute angle to the pass line of the rolling stand.

To color the upper side of the strip, the coloring roll is lowered from the initial position above the strip until the axis of the roll near the roll gap is located somewhat below the axes of the other adjustable rolls in the working position.

To color the underside of the strip, the coloring roll is raised from the initial position below the strip until the axis of the roll near the roll gap is located somewhat above the axes of the rolls that are arranged in fixed positions below the strip flow.

Due to the possibility of using the roll near the roll gap as a bridle roll or coloring roll, the distance between the roll gap and payoff does not increase even when additional coloring of the strip is necessary.

If the roll situated closest to the roll gap of the rolling stand can be moved into any desired intermediate positions between the initial positions above and below the strip flow, different bite angles to the pass line can be adjusted during the coloring of the strip. In addition, this feature allows improved adaptation of the bridle unit to strips of different thicknesses in both the bridle mode and coloring mode. Bite angles that are suitable from the standpoint of process engineering vary between ±14 degrees relative to the pass line.

To be able to adjust any desired intermediate position of the rolls near the roll gap, especially by computerized process control, an advantageous refinement of the invention provides for a position sensor, which detects the position of the roll.

In an advantageous refinement of the invention, the additional drive for the roll near the roll gap is designed especially as a hydraulic cylinder that is operated by a pressure medium and can be acted upon from both sides. Alternatively, however, it is also possible to use other mechanical or electrical drives, which allow essentially vertical movement of the roll near the roll gap from an initial position above and below the strip flow into different intermediate positions for the bridle-color operation of the roll.

The bridle unit of the invention can be used in all rolling stands for rolling nonferrous metals or steels, in which a bridle unit with several rolls is necessary and, at the same time, there is the requirement of a bite angle of the strip into the rolling stand that differs from the pass line. If the rolling stands are designed as reversing stands rather than one-way stands, the bridle unit of the invention is preferably arranged on both sides.

The invention is explained in greater detail below on the basis of an embodiment.

FIG. 1 is a representation of an example of the invention with a 5-roll bridle unit with an associated rolling stand.

Figure 2A:
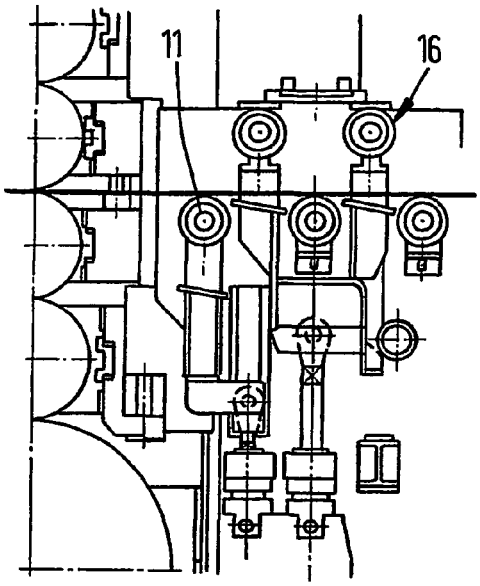

FIGS. 2*a, b* show the use of the bridle unit of FIG. 1 in bridle mode.

Figure 3A:
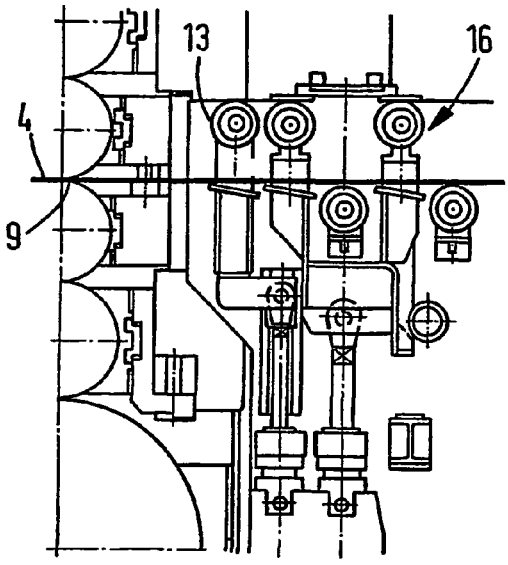

FIGS. 3*a, b* show the use of the bridle unit of FIG. 1 in coloring mode for coloring the upper side of the strip.

Figure 4A:
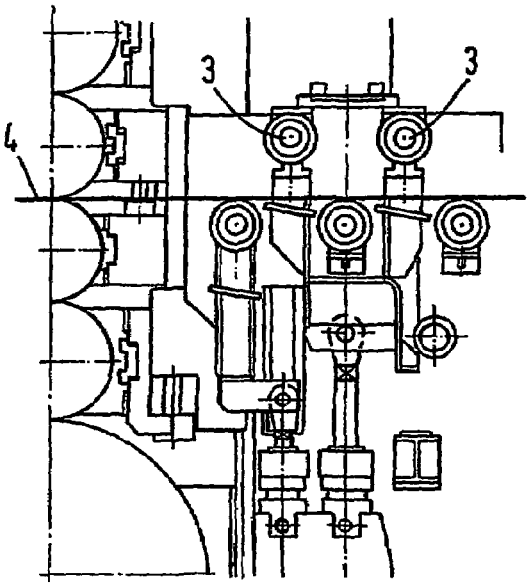

FIGS. 4*a, b* show the use of the bridle unit of FIG. 1 in coloring mode for coloring the underside of the strip.

FIG. 1 shows a bridle unit 2 assigned to a rolling stand 1, which is only partially shown. The rolls 3 of the bridle unit that are arranged above the strip flow can be moved from the initial position shown in FIG. 1 into a working position, in which the rolls 3 rest on the strip 4 (compare FIGS. 2*b*, 3*b*, and 4*b*).

Below the strip flow, two additional rolls 5 are arranged in fixed positions in bearing blocks 6 in staggered positions relative to the rolls 3. The roll jackets 7 of the rolls 5 extend to the pass line 8 (shown in FIG. 1) of the strip 4 (not shown).

A roll 11 of the bridle unit 2, which (roll 11) is situated closest to the roll gap 9 of the rolling stand 1, can be moved vertically to the pass line 8 from the initial position 12 shown in FIG. 1 below the strip flow into an initial position 13 shown in FIG. 3*a* above the strip flow and into any position between the initial positions 12 and 13.

The initial position 12 of the roll 11 near the roll gap corresponds to the position of the rolls 5 arranged in fixed positions below-the strip flow, whereas the initial position 13 of the roll 11 near the roll gap corresponds to the initial position of the adjustable rolls 3 arranged above the strip flow (see FIG. 3*a*)

Figure 2B:
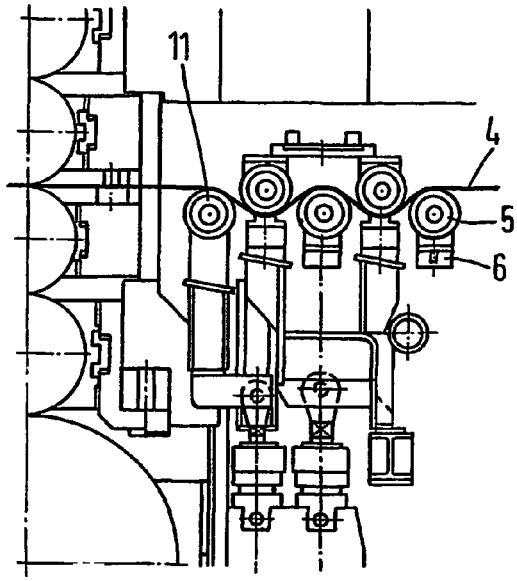
Figure 3B:
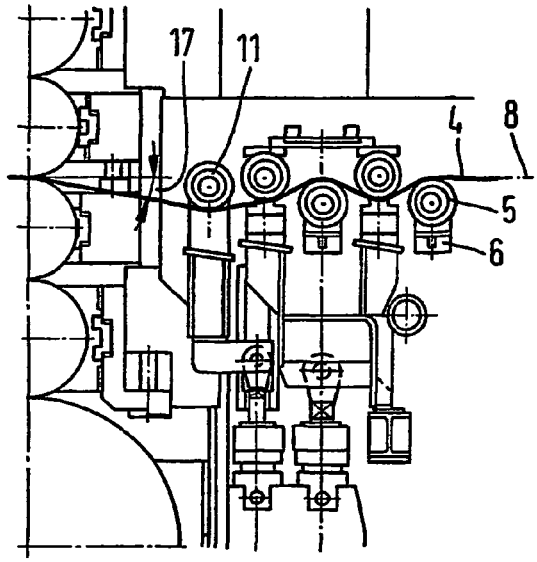
Figure 4B:
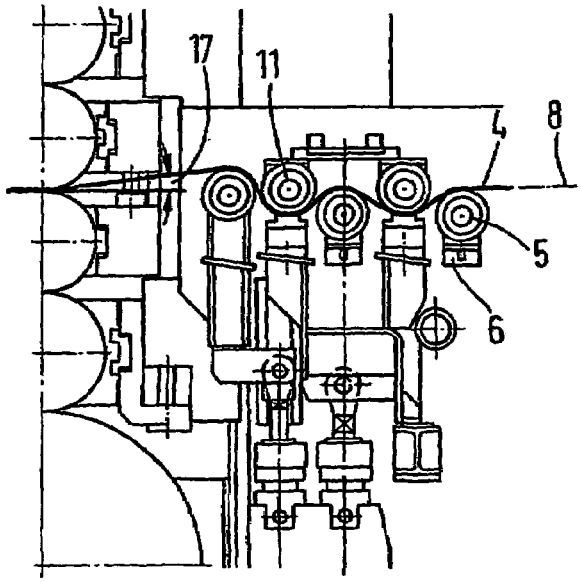

The different operating modes of the bridle unit of the invention are explained below with reference to FIGS. 2-4, in which FIGS. 2*a*, 3*a*, and 4*a* show the threading of the strip for the given operating mode, and FIGS. 2*b*, 3*b*, and 4*b* show the operating mode itself.

If the bridle unit is to be operated in the bridle mode according to FIG. 2*b*, the roll 11 near the roll gap remains in its initial position 12 at the height of the rolls 5 that are arranged in fixed positions. The rolls 3, which are arranged on a support frame 14, are moved by a hydraulic cylinder 15 from the initial position 16 towards the upper side of the strip 4, so that the strip 4 is alternately bent by the rolls 3, 5, and 11 and leaves the roll 11 that is near the roll gap at the height of the pass line 8.

To color the upper side of the strip 4, the rolls 3 and the roll 11 that is near the roll gap are brought into their respective initial positions 16 and 13, and the strip is placed on the two fixed rolls 5. The rolls 3 are then lowered onto the upper side of the strip 4 to produce alternate bending, as shown in FIG. 3*b*. The roll 11, which acts as the coloring roll, is lowered slightly more than the rolls 3 to adjust a bite angle of the strip into the roll gap 9 that is different from the pass line 8.

To color the underside of the strip 4, the rolls 3 are brought into their initial position 16, and the roll 11 near the roll gap is brought into its initial position 12, and the strip is placed on the two fixed rolls 5 and the roll 11 near the roll gap. The rolls 3 are then lowered onto the upper side of the strip 4 to produce alternate bending, as shown in FIG. 4*b*. The roll 11 near the roll gap, which acts as the coloring roll, is slightly raised relative to the fixed rolls 5 to adjust a bite angle of the strip into the roll gap 9 that is different from the pass line 8.

To allow continuous adjustment of the bite angle, for example, to different strip thicknesses, strip speeds, or strip materials, the roll 11 situated near the roll gap can be moved by a hydraulic cylinder 18 into any desired intermediate positions between the initial positions 12 and 13. The piston rod 19 of the hydraulic cylinder 18 engages a support frame 22, which can be moved in a vertical guide 21. The right-angled design of the support frame 22 allows arrangement of the hydraulic cylinder 18 directly alongside the hydraulic cylinder 15 for the adjustable rolls 3 of the bridle unit 2, which are located above the strip flow. The spatially close arrangement of the hydraulic cylinders 15, 18, together with the angled support frame 22, makes it possible to achieve a smaller distance to the rolling stand 1 than a straight design of the support frame in linear extension of the piston rod 19 of the hydraulic cylinder 18.

The embodiments illustrate that the roll 11 situated near the roll gap, which is consistent with the other rolls with respect to the center-to-center distance in the direction of the pass line 8, fulfills the dual function of the invention without any disadvantages for the rolling process, especially because the overall length of the bridle unit is unchanged. Therefore, a lengthening of the distance between the roll gap 9 and the payoff is not associated with the bridle unit of the invention.

LIST OF REFERENCE NUMBERS

No. Name
1 rolling stand
2 bridle unit
3 rolls (movable)
4 strip
5 rolls (fixed)
6 bearing block
7 roll jacket
8 pass line
9 roll gap
10 --
11 roll (near the roll gap)
12 initial position of 11
13 initial position of 11
14 support frame of 3
15 hydraulic cylinder of 14
16 initial position of 3
17 bite angle
18 hydraulic cylinder of 22
19 piston rod
20 --
21 vertical guide
22 support frame of 11

The invention claimed is:

1. A bridle unit assigned to a rolling stand with several rolls arranged in adjustable positions below and above a strip flow, which can be moved by means of a drive from an initial position to a strip and from the strip back into the initial position, wherein a roll (11) situated closest to a roll gap (9) of a rolling stand (1) can be moved by means of an additional drive (18) from an initial position (12) below the strip flow or from an initial position (13) above the strip flow to the strip (4) and is useable as a bridle roll and as a color roll, such that, when the bridle unit is used for coloring the strip (4), the circumference of the roll (11) deflects the strip (4) upward or downward from a horizontal pass line (8) and forms a bite angle (17) above or below the pass line (8), the bite angle being between ±14° relative to the pass line.

2. Bridle unit in accordance with claim 1, wherein the roll (11) situated closest to the roll gap (9) of the rolling stand (1) can be moved into any desired intermediate position between the initial position (12) below the strip flow and the strip (4) or between the initial position (13) above the strip flow and the strip (4).

3. Bridle unit in accordance with claim 2, wherein a position sensor detects the position of the roll (11) that is situated closest to the roll gap (9) of the rolling stand (1).

4. Bridle unit in accordance with claim 1, wherein the additional drive (18) is designed as a cylinder that is operated by a pressure medium and can be acted upon from both sides.

5. Bridle unit in accordance with claim 4, wherein a piston rod (19) of the cylinder (18) engages a support frame (22) for the roll (11) situated closest to the roll gap (9) of the rolling stand (1), and the support frame (22) can be moved in a vertical guide (21).

* * * * *